United States Patent [19]

Wilcox

[11] Patent Number: 4,713,949

[45] Date of Patent: Dec. 22, 1987

[54] SHELF SYSTEM FOR APPLIANCE

[75] Inventor: John R. Wilcox, Farrell, Pa.

[73] Assignee: Top Shelf Company, Inc., West Middlesex, Pa.

[21] Appl. No.: 783,633

[22] Filed: Oct. 3, 1985

[51] Int. Cl.[4] ..... D06F 39/00

[52] U.S. Cl. ..... 68/235 R; 68/3 R; 108/91; 108/102; 248/241; 211/134; 211/186; 211/153

[58] Field of Search ..... 312/233, 281, 282, 255, 312/256; 108/156, 154, 91, 5 U, 137, 47, 143, 161, 149, 153; 211/134, 186, 153, 201; 68/3 R, 235, 240; 248/235, 241

[56] References Cited

U.S. PATENT DOCUMENTS

| | | | |
|---|---|---|---|
| 905,737 | 12/1908 | McCombe . | |
| 1,038,813 | 9/1912 | Young | 108/91 |
| 1,043,950 | 11/1912 | Martin . | |
| 1,069,411 | 8/1913 | Greene . | |
| 1,234,628 | 7/1917 | Christensen | 108/91 |
| 1,596,812 | 8/1926 | Curtis | 211/134 X |
| 1,830,347 | 11/1931 | Camden et al. . | |
| 1,852,357 | 4/1932 | Merhar . | |
| 1,872,740 | 8/1932 | James . | |
| 2,503,132 | 4/1950 | Robinson et al. | 126/332 |
| 2,903,316 | 9/1959 | Schmidt | 312/279 X |
| 3,126,102 | 3/1964 | Krokos . | |
| 3,303,936 | 2/1967 | Barnawell | 211/134 |
| 3,998,170 | 12/1976 | Gordon | 211/153 X |
| 4,140,064 | 2/1979 | Krakow . | |
| 4,155,312 | 5/1979 | Thorkildson . | |
| 4,414,959 | 11/1983 | Fair et al. | 126/332 |
| 4,507,942 | 4/1985 | Hirose et al. . | |

FOREIGN PATENT DOCUMENTS

| | | | |
|---|---|---|---|
| 3213420 | 10/1983 | Fed. Rep. of Germany | 68/3 R |
| 59-11892 | 1/1984 | Japan | 68/3 R |

*Primary Examiner*—Timothy F. Simone
*Assistant Examiner*—Frankie L. Stinson
*Attorney, Agent, or Firm*—Neuman, Williams, Anderson & Olson

[57] ABSTRACT

A shelf assembly is disclosed for use with an appliance. The appliance has a top work surface with opposing side edges and a control panel disposed at a rear portion of and extending above the top work surface. The shelf assembly comprises a tray for providing an additional work surface and having opposite first and second ends. First and second side support panels are disposed substantially vertically and each has a top end adapted to be attached to a corresponding one of the first and second ends of said tray and a bottom end adapted for resting upon the top work surface. A bracket extends between and is attached at opposite ends to the first and second side support panels, respectively. The bracket has at least one foot disposed at a height above the top work surface and rests on the top of the control panel to steady the shelf assembly and to orient the additional work surface horizontally.

8 Claims, 6 Drawing Figures

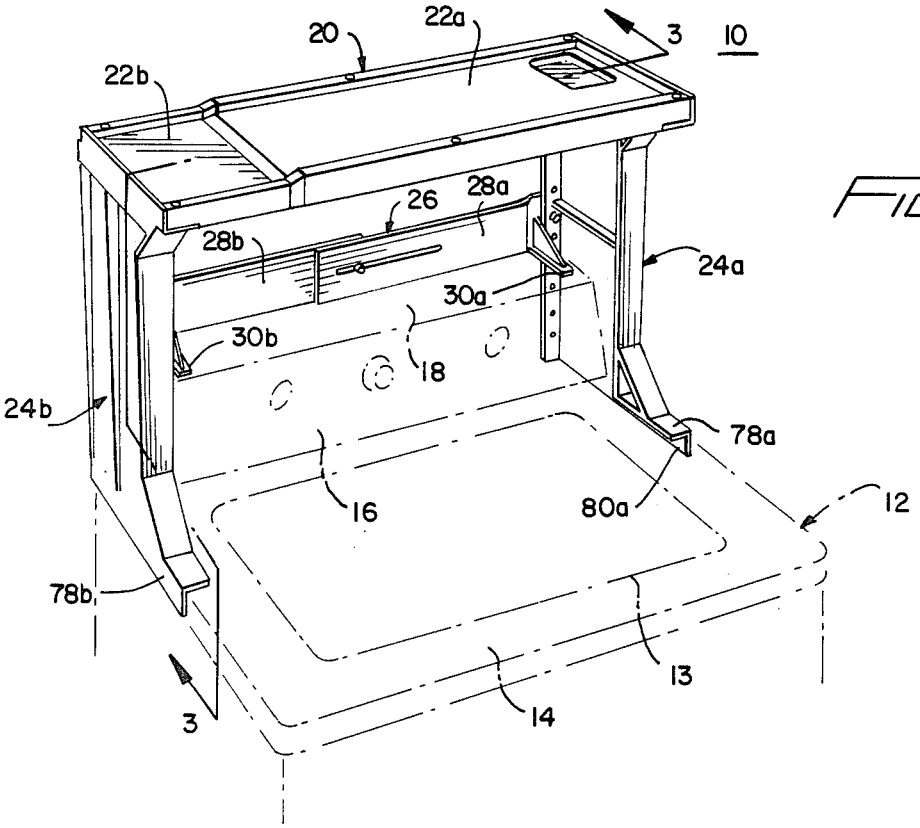
FIG 1
FIG 3
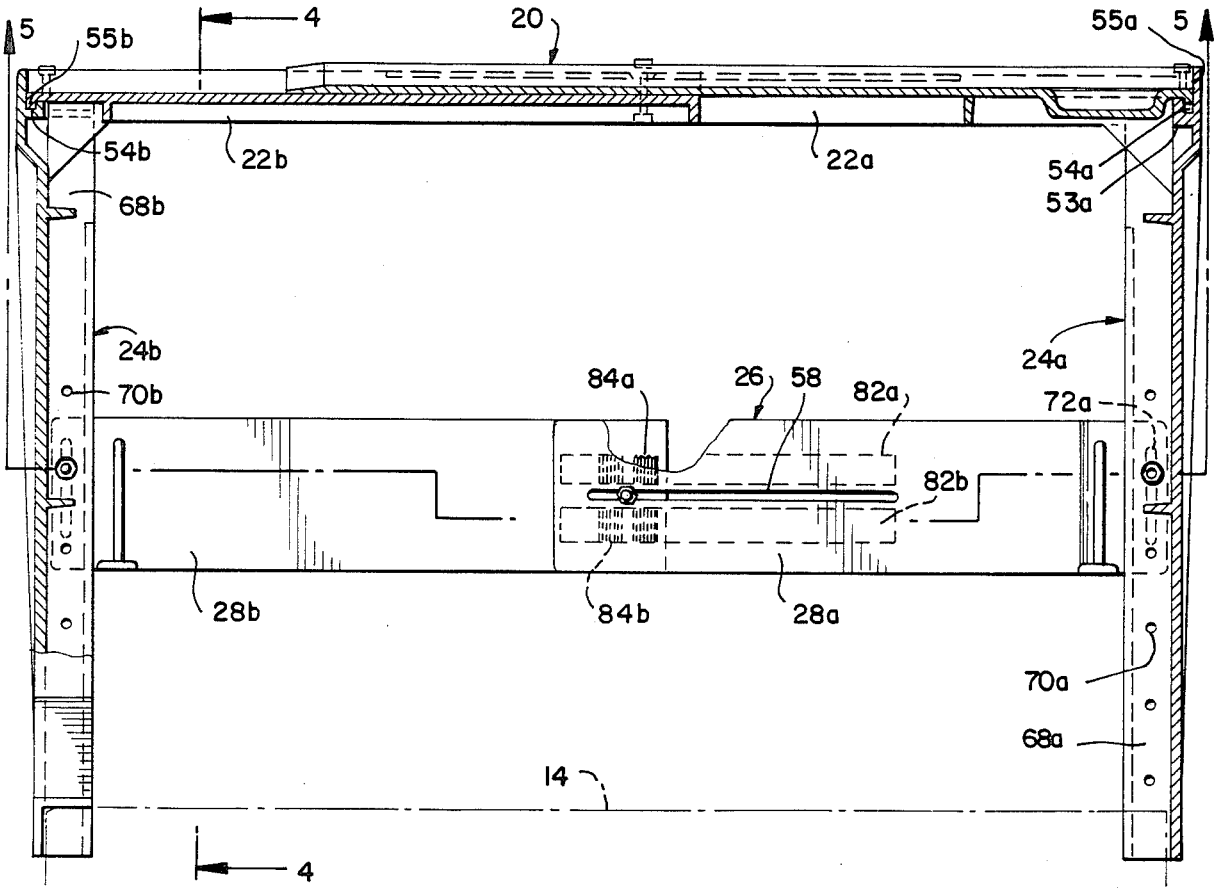

SHELF SYSTEM FOR APPLIANCE

BACKGROUND OF THE INVENTION

1. Field of the Invention

The present invention relates to shelves and, in particular, shelf systems adapted to be solely supported upon an appliance, e.g. a laundry unit, to provide an additional work surface.

2. Description of the Prior Art

Shelf systems are known for various applications. Commonly assigned U.S. Pat. No. 4,414,959 of Fair et al., discloses a shelf for a range including a platform and first and second support or side members for suspending the platform above the burner area of the range. The platform is designed to receive and support relatively heavy objects, such as a microwave oven. The support members include a pair of channel members adapted to engage the drip rails of the range. The platform is disposed above the burner area and extends forwardly of the support members. When the microwave oven is placed on the platform, a forward moment is established, whereby the pair of channels are pressed into an engaging relationship with the drip rails and the shelf is securely mounted upon the range.

Some appliances, such as laundry units, are top mounting in the sense that a door is provided that swings up to permit access to the appliance. Often, such access doors limit the work surface provided by such an appliance, and it is desirable to provide a shelfing arrangement easily adapted to be mounted upon such an appliance that offers additional work surface, without interfering with the operation of such appliances.

Typically, laundry units are manufactured with control panels and top surfaces of varying dimensions. To be mounted on said laundry units, shelf systems must accommodate the various dimensions of the top surface and the presence of a control panel and, yet, provide stable attachment to the appliance. In laundry units, the control panel may be of such configuration and dimension so as to prevent ready attachment thereto. It is contemplated that the placement of heavy objects, e.g., soap detergents, on such a support shelf, may topple the shelfing system. In particular, a heavy object resting on such work surface could create a moment that would rotate the shelfing system backwards so as to topple it from the laundry unit.

Though not related to appliances or, in particular, to laundry units, U.S. Pat. No. 4,140,064 of Krakow discloses a table top support that is adapted to be installed within an area bounded by three adjacent walls. The Krakow support includes two side members separated by compression members of varying length to accommodate the space between opposing walls, whereby the support members may be disposed adjacent the opposing walls. Further, U.S. Pat. Nos. 905,737 of McCombe; 1,043,950 of Martin; 1,069,411 of Greene; 1,830,347 of Camden et al.; 1,852,357 of Merhar; and 1,872,740 of James; and 4,155,312 of Thorkildson et al., all disclose varying forms of shelves that interfit and telescope with each other to permit adjustment of a shelf to a varying area.

SUMMARY OF THE INVENTION

It is therefore an object of this invention to provide a new and improved shelf system particularly adapted to be mounted upon appliances of varying dimensions and configurations to provide further work surface.

It is a further, more specific object of this invention to provide a shelf system for a laundry unit capable of providing secure mounting thereof upon the top work surface and control panel thereof.

In accordance with these and other objects of the invention, there is provided a shelf assembly for use with an appliance. The appliance has a top work surface with opposing side edges and a control panel disposed at a rear portion of and extending above the top work surface. The shelf assembly comprises a tray for providing an additional work surface wih opposing first and second ends. First and second side support panels are disposed substantially vertically and, each, comprises a top end adapted to be attached to a coresponding one of the first and second ends of the tray and a bottom end adapted for resting upon the top work surface. A bracket extends between and is attached at opposite ends to the first and second side support panels respectively. The bracket has at least one foot disposed at a height above the top work surface and resting on the top of the control panel to steady the shelf assembly and to orient the additional work surface horizontally.

BRIEF DESCRIPTION OF THE DRAWINGS

A detailed description of the perferred embodiment of this invention is hereafter made with specific reference to the drawings, in which:

FIG. 1 is a perspective view of the shelf system mounted upon an appliance in accordance with the teachings of this invention;

FIG. 3 is a section view of the shelf arrangement taken along line 3—3 of FIG. 1;

DETAILED DESCRIPTION OF A PERFERRED EMBODIMENT

Figure 2:
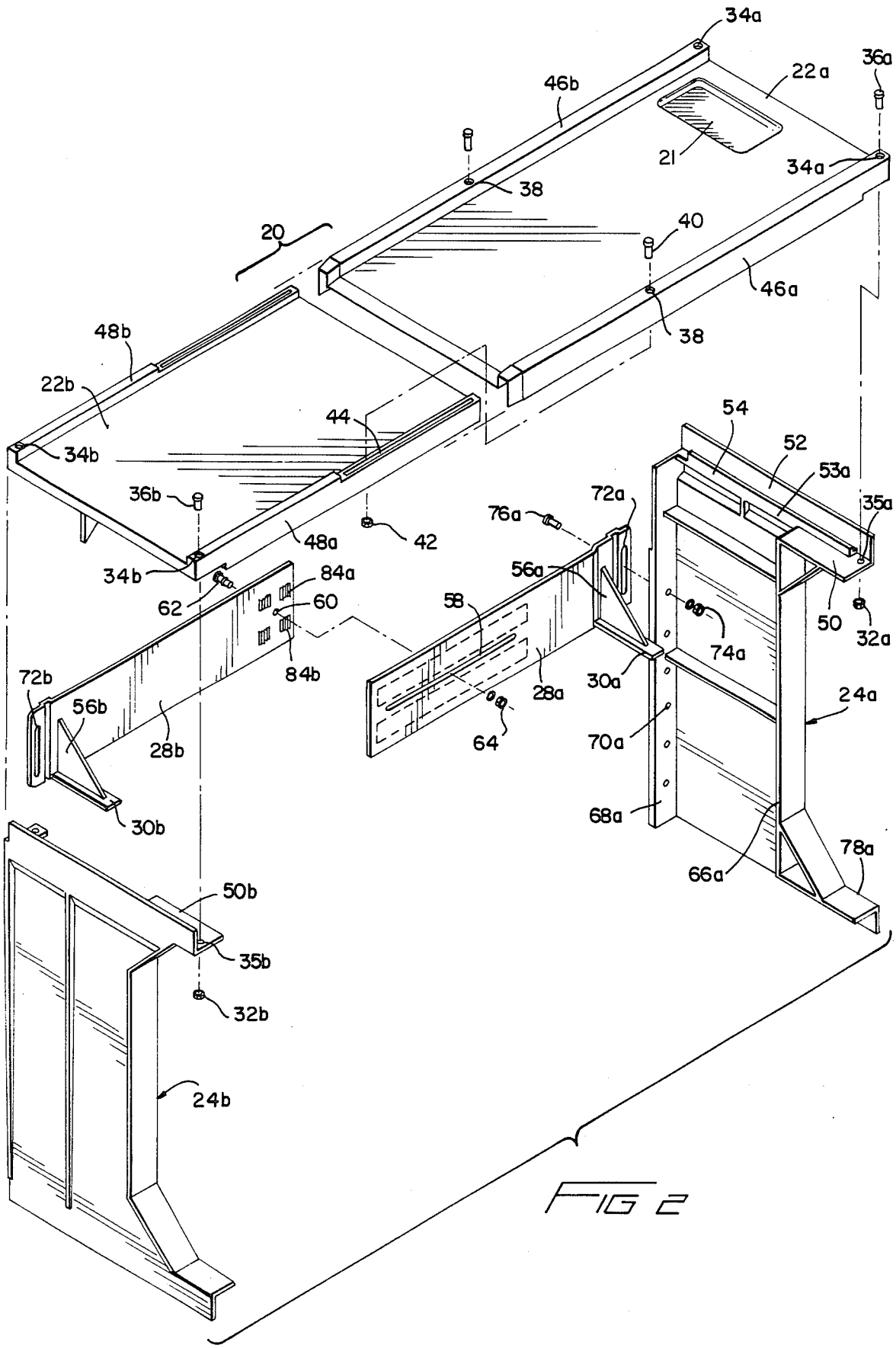
FIG. 2 is an exploded, perspective view of the shelf system as shown in FIG. 1, illustrating the manner in which the elements of the shelf system are assembled.

With reference to the drawings and, in particular, to FIG. 1, there is shown a shelf assembly 10 adapted to be mounted upon a top work surface 14 of a laundry unit 12. As illustrated in FIG. 1, the laundry unit 12 has a door 13 hinged to be lifted up, whereby clothes may be loaded into the laundary unit 12. The presence of such a door 13, limits the available work surface, plus making it desirable to provide additional work or storage surface that can be used for folding clothes, or the storage of cleaning products as may be useful in the operation of the laundry unit 12. Such additional work and/or storage surface is provided by the shelf assembly 10.

The shelf assembly 10 includes a top tray 20 supported at either end by one of a pair of side support panels **24*a* and 24*b*. A lost and found recess 21 is provided in the top most surface of the part 22*a* of the top tray 20, to provide a storage space for coins or other articles left in the clothes to be cleaned. Further, a support bracket 26 is disposed horizontally between and attached at its ends to the side supports panels 24*a* and 24*b*. The laundry unit 12 includes a control panel 16 that extends above the top work surface 14 at the rear of the laundry unit 12. The support bracket 26 has at either end a support foot 30 that extends outward toward the front of the laundry unit 12 to provide support for the shelf assembly 10. It may be appreciated that if a heavy object, such as a container of a cleaning substance, were to be disposed upon the top shelf 20, that a moment would be developed by the weight of such container, tending to topple the shelf assembly 10 over the back edge of the laundry unit 12. The pair of feet 30***a* and 30*b* rests upon a top panel surface 18 of the control panel 16 to resist such toppling and to provide secure mounting of the shelf assembly 10 upon the laundry unit 12.

Referring now to FIGS. 2 and 3, the detailed construction of the top tray 20 will be described. The top tray 20 comprises a pair of telescoping parts 22*a* and 22*b* interfitting with each other. The part 22*a* has a pair of grooves 46*a* and 46*b* disposed respectively at its leading and trailing edges that are designed to receive a corresponding pair of tongues 48*a* and 48*b* disposed on the part 22*b*. The parts 22*a* and 22*b* are designed to telescope together to form a tray 20 of a length selected according to the width of the laundry unit 12. The laundry unit 12 has a top work surface 14, whose width may vary. The parts 22*a* and 22*b* are adjusted relative to each other to provide an aggragate length corresponding to the width of the top work surface 14. Thereafter, a pair of bolts 40 are disposed, as shown in FIG. 2, through openings 38 of the part 22*a*, and through slots 44 of the part 22*b* and, then, are fastened to nuts 42, whereby the parts 22*a* and 22*b* are fastened together.

As shown in FIG. 2, opposite ends of the tray 20 are secured to the top most portions or edges of the side support panels 24*a* and 24*b*, respectively. Each side support panel 24 includes a support surface 50 and a side flange 52 for receiving as shown in FIG. 3, the respective end of the top tray 20. An L-shaped member 53 is disposed adjacent the side flange 42 to define a groove 54, as particularly shown in FIG. 3. A pair of tongues 55*a* and 55*b* are disclosed at either end of the top tray 20 and are disposable within a corresponding one of the grooves 54*a* and 54*b*. Thereafter, a pair of bolts 36*a* is disposed through a first pair of openings 34*a* and a second pair of openings 35*a* within the support surface 50*a*, to be fastened with nuts 32*a*, whereby one end of the top tray 20 is fixedly secured to the right side support panel 24*a*. In a similar fashion, a pair of bolts 36*b* is disposed through a first pair of openings 34*b* and a second pair of openings 35*b* within the support surface 50*b*, to be attached to a pair of nuts 32*b*, whereby the other end of the tray 20 is secured to the left side support panel 24*b*.

Figure 4:
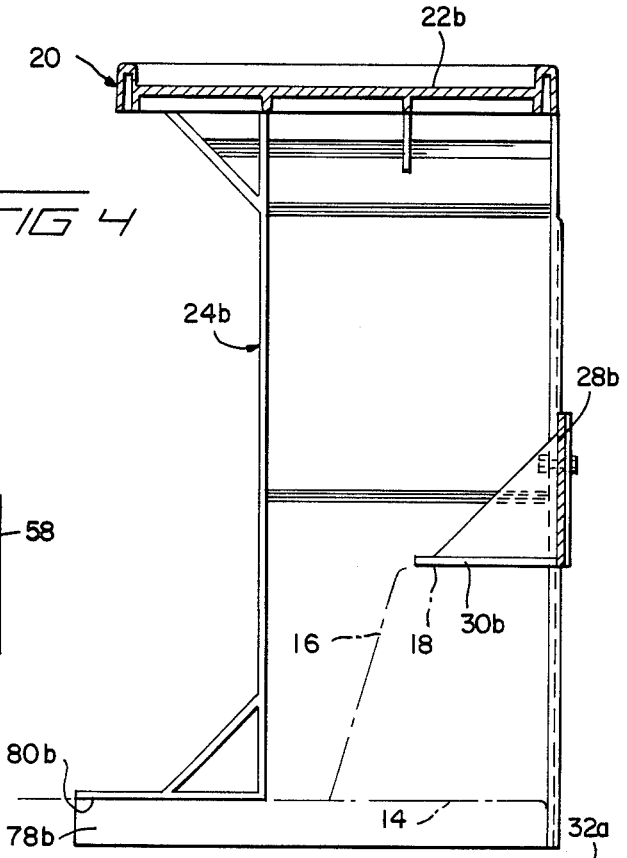
FIG. 4 is a side, section view taken along line 4—4 of FIG. 3.

As illustrated in FIGS. 1, 3 and 4, each of the right and left side support panels 24*a* and 24*b* has a L-shape retaining flange 78 adapted to overlay opposing edges of the top work surface 14 of the laundry unit 12. Each of the L-shaped retaining flanges 78*a* and 78*b* includes a support surface 80 directly abutting the top work surface 14. Further as shown particularly in FIG. 2, each of the right and left side support panels 24*a* and 24*b*, includes a front rib 66 and a rear rib 68 which provide rigidity to its panel 24. A series of openings 70 is disposed in each of the rear ribs 68.

Figure 6:
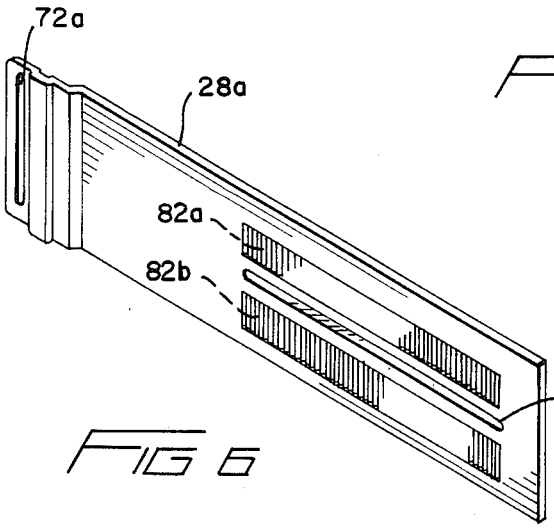
FIG. 6 is a perspective view of one member of the support bracket interconnecting the side support panels, as shown in FIG. 1.
Figure 5:
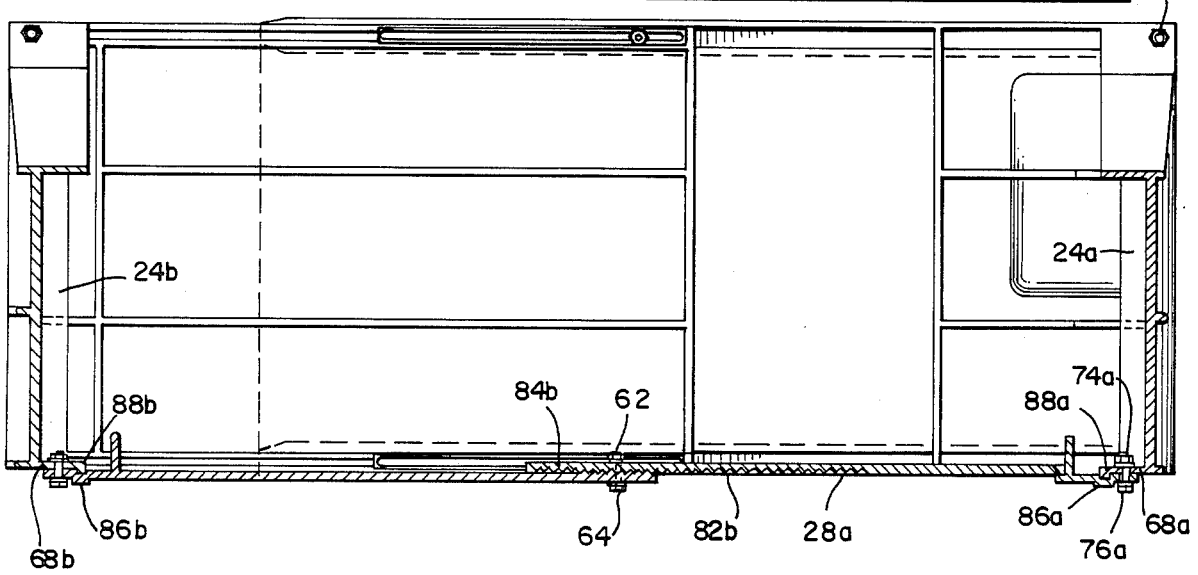
FIG. 5 is a bottom, section view of the shelf system taken along line 5—5 of FIG. 3.

As particularly shown in FIGS. 2, 5 and 6, the support bracket 26 includes a pair of members 28*a* and 28*b*. One of a pair of slots 72 and 72*b* is disposed at one end of each of the members 28*a* and 28*b*. The members 28*a* and 28*b* are secured together by a bolt 62 disposed through an opening 60 within the member 28*b* and an elongated slot 58 within the member 28*a*, to be fastened to a nut 64. The slot 58 permits the aggragate length of the members 28*a* and 28*b* to be adjusted to correspond to that of the width of the top work surface 18. A bolt 76*a* is disposed through the slot 72*a* and one of the openings 70*a* to be fastened to a nut 74*a*. The height of the support bracket 26 and its members 28*a* and 28*b*, is set corresponding to the height of the top panel surface 18, as illustrated in FIG. 4. The particular opening 70*a* is selected and the groove 72*a* permits continuous adjustment of the height of the support bracket 26. As particularly illustrated in FIGS. 2, 5 and 6, the member 28*a* has a first set of teeth 82*a* and 82*b* disposed upon its rearwardly facing surface. The member 28*b* has a second set of teeth 84*a* and 84*b* designed to engage the first set of teeth 82*a* and 82*b* to prevent the relative sliding of the members 28*a*. A groove 86 is disposed at remote ends of the members 28 for engaging each of a matching tongue 88 to thereby facilitate the sure coupling of the members 28 to the right and left side support panels 24*a* and 24*b* and, in particularlly, to their rear ribs 68*a* and 68*b*.

As particularly shown in FIG. 4, the height of the support bracket 26 above the top work surface 14 is adjusted so that the support feet 30 as affixed to the support bracket 26, lay directly on the top panel surface 18 to provide, along with the L-shaped retaining flanges 78*a* and 78*b*, means for securely mounting the shelf assembly 10 upon the laundry unit 12. It may be appreciated from viewing FIGS. 4, that the placement of a heavy object on the top tray 20 creates a moment in a clockwise direction as viewed in FIG. 4, tending to topple the shelf assembly 10 over the rear edge of the laundary unit 12. Such moment is checked by the use of the support feet 30, which serve to level and to support the shelf assembly 10 with respect to the laundry unit 12.

In considering this invention, it should be remembered that the present disclosure is illustrative only and the scope of the invention should be determined by the appended claims.

I claim:

1. A shelf assembly for use with an appliance, the appliance having a top work surface with opposing side edges and a control panel disposed at a rear portion of and extending above the top work surface, said shelf assembly comprising:

(a) a tray for providing an additional work surface and having opposing first and second ends;

(b) first and second side support panels disposed substantially vertically, each of said first and second side support panels having a top end attached to a corresponding one of said first and second ends of said tray and a bottom end resting upon the top work surface; and (c) a bracket extending between and attached at opposite ends to said first and second side support panels respectively, said bracket having at least one foot disposed at a height above the top work surface and resting on the top of the control panel to steady said shelf assembly and to orient said additional work surface horizontally.

2. The shelf assembly as claimed in claim 1, wherein there is included adjustable means for attaching said opposite ends of said bracket to said first and second side support panels respectively to facilitate a continuous adjustment in height above the top work surface.

3. The shelf assembly as claimed in claim 1, wherein there is included means for adjusting the length of said bracket to a length substantially equal to that dimension between the opposing side edges of the appliance.

4. The shelf assembly as claimed in claim 3, wherein said bracket comprises first and second members, each having first and second ends, means for adjustably securing said second ends of said members together in a manner to permit adjustment of the aggragate length of said first and second members, and means for attaching said first ends of said first and second members to said first and second side support panels, respectively.

5. The shelf assembly as claimed in claim 1, wherein there is included means for adjusting the length of said tray between its first and second ends to a length substantially equal to that dimension between the opposing side edges of the appliance.

6. The shelf assembly as claimed in claim 5, wherein said tray comprises first and second members, each having first and second ends, and means for securing said second ends of said first and second members together.

7. The shelf assembly as claimed in claim 6, wherein said first member has a tongue disposed along a lateral edge thereof and said second member has a groove disposed along a lateral edge thereof and configured to receive said tongue, whereby said first and second members telecope with respect to each other.

8. The shelf assembly as claimed in claim 1, wherein each of said first and second side support panels includes an L-shaped flange connected to its bottom edge for overlaying a corresponding side edge of the appliance.

* * * * *